US005449090A

United States Patent [19]

Rodriguez

[11] Patent Number: 5,449,090

[45] Date of Patent: Sep. 12, 1995

[54] LABEL DISPENSER

[75] Inventor: Humberto Rodriguez, Wabash, Ind.

[73] Assignee: Martin Yale Industries, Inc., Wabash, Ind.

[21] Appl. No.: 212,498

[22] Filed: Mar. 11, 1994

[51] Int. Cl.[6] ..... B65H 5/28

[52] U.S. Cl. ..... 221/73; 221/10

[58] Field of Search ..... 221/70, 71, 72, 73, 221/10

[56] References Cited

U.S. PATENT DOCUMENTS

| | | | |
|---|---|---|---|
| D. 273,202 | 3/1984 | Oglander et al. . | |
| 2,602,719 | 7/1952 | Thiene et al. | 221/73 |
| 3,186,589 | 6/1965 | West et al. | 221/73 X |
| 3,537,933 | 11/1970 | Severance | 221/73 X |
| 3,941,278 | 3/1976 | Oglander et al. | 221/73 |
| 4,194,646 | 3/1980 | Oglander et al. | 221/73 |
| 4,214,938 | 7/1980 | Figg | 221/73 X |
| 4,496,049 | 1/1985 | Pabodie et al. | 221/70 X |
| 4,585,144 | 4/1986 | Granzow et al. | 221/73 X |
| 4,813,571 | 3/1989 | Slagter | 221/73 X |
| 4,826,558 | 5/1989 | Wada et al. | 221/73 X |
| 5,065,896 | 11/1991 | Jurgich | 221/73 |
| 5,071,030 | 12/1991 | Marcuser | 221/73 X |

*Primary Examiner*—William E. Terrell
*Assistant Examiner*—Dean A. Reichard
*Attorney, Agent, or Firm*—Willian Brinks Hofer Gilson & Lione

[57] ABSTRACT

The invention provides a label dispenser for separating adhesive backed labels from their backing paper and method of operating the same. The label dispenser comprises a base, and a body attached to a top surface of the base and having a motor housing portion, a microswitch housing portion, and an upper tray portion. A gear motor is enclosed in the motor housing portion and has an opening for receiving a shaft. The shaft extends outside the motor housing portion and below the upper tray portion through an opening formed in a side wall of the motor housing portion. A microswitch is attached to an inner wall of the microswitch housing portion. The microswitch is electrically connected to the motor and has a lever arm extending upward into an opening formed in the microswitch housing portion.

20 Claims, 3 Drawing Sheets

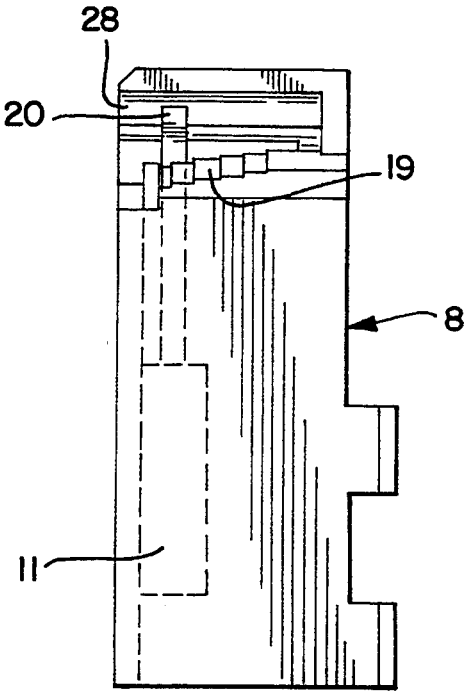
FIG. 4
FIG. 5
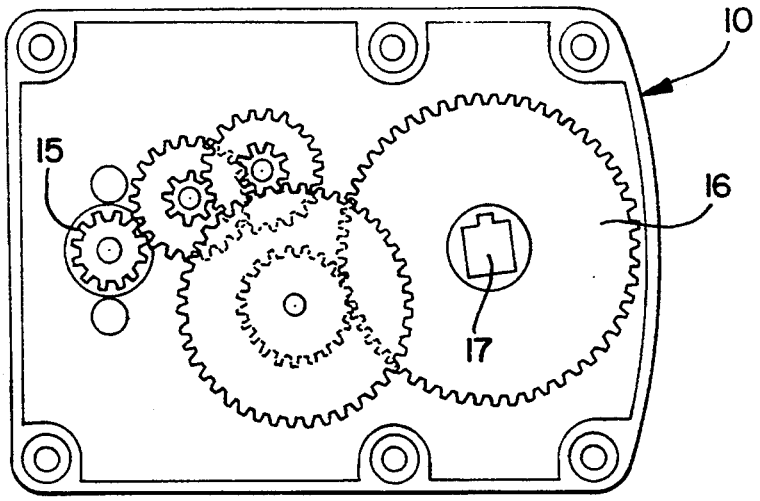

LABEL DISPENSER

BACKGROUND OF THE INVENTION

This invention relates to a label dispenser used in separating the adhesive backed label from its backing paper and method of using this label dispenser.

Existing label dispensers are housed in metal bodies. In addition these dispensers use belts, pulleys and an electric motor or metal gear motors as a transmission to drive a take-up shaft that rolls up the backing paper after the labels have been removed. It would be desirable to use a light weight gear motor with plastic gears as a transmission which would be both lighter and quieter than existing transmissions. It would also be desirable to mold the base and body of the label dispenser out of a light weight plastic material. These plastic members could be snapped together to provide for easy assembly and eliminate the need for fasteners. It would also be desirable to have a separate detachable plastic portion for housing a microswitch. A plastic lip portion formed on the microswitch housing portion with a ridged or stepped surface would be beneficial in reducing the contact area of the adhesive backed label. The reduced surface contact would aid in preventing jamming and would allow for easy removal of the label.

SUMMARY OF THE INVENTION

The invention provides a label dispenser for separating adhesive backed labels from their backing paper and method of operating the same. The label dispenser comprises a base, and a body attached to a top surface of the base and having a motor housing portion, a microswitch housing portion, and an upper tray portion. A gear motor is enclosed in the motor housing portion and has an opening for receiving a shaft. The shaft extends outside the motor housing portion and below the upper tray portion through an opening formed in a side wall of the motor housing portion. A microswitch is attached to an inner wall of the microswitch housing portion. The microswitch is electrically connected to the motor and has a lever arm extending upward into an opening formed in the microswitch housing portion.

The invention also provides for a stepped or ridged lip portion formed on an upper portion of the microswitch housing portion for reducing the contact area with the adhesive side of a label. A gear motor comprising an electric motor and a plastic gear assembly is also provided. A plastic base and body that are snapped together with openings formed on the base along its edge for receiving tabs formed on the bottom edge of the body are also provided. A separate plastic microswitch housing portion can be snapped onto the body. The invention further provides for a feed slot formed between an upper surface of the tray and a hold down bar formed above said surface.

The invention provides a method of operating a label dispenser. A lead-in portion of a carrier sheet is fed through a feed slot formed in a tray portion of a body of the label dispenser. The body is attached to a base portion and has a motor housing portion for holding a gear motor and a microswitch housing portion for holding a microswitch. The lead-in portion of the carrier sheet is fed downward between a feed edge of the tray portion and a lip portion of the microswitch housing portion. The microswitch housing portion has a pocket formed therein for allowing a lever arm of the microswitch to extend into the pocket. The front edge of the lead-in portion is inserted into a slot formed in a take-up shaft. The shaft extends through an opening in a side wall of the motor housing portion and is attached to the gear motor. A manual switch is switched on to activate the gear motor which rotates the shaft. The manual switch is electrically connected to the gear motor and to the microswitch, and is fitted in an opening formed in the body. The motor is connected to an electric cord and plug that is inserted in an electrical outlet. The carrier sheet is rolled onto the rotating shaft until a first label contacts the lever arm in the label pocket which deactivates the motor. The label may then be removed from the label pocket. This action releases the lever arm and reactivates the motor which rotates the shaft and advances the carrier sheet to separate the next label from the backing paper.

The present invention, together with its attendant objectives and advantages, will be further understood with reference to the detailed description and the accompanying drawings.

BRIEF DESCRIPTION OF THE DRAWINGS

FIG. 4 is a sectional view of the microswitch housing portion with the microswitch shown in phantom.

FIG. 5 is a schematic view of the plastic gear assembly.

DETAILED DESCRIPTION OF AN EMBODIMENT

Figure 1:
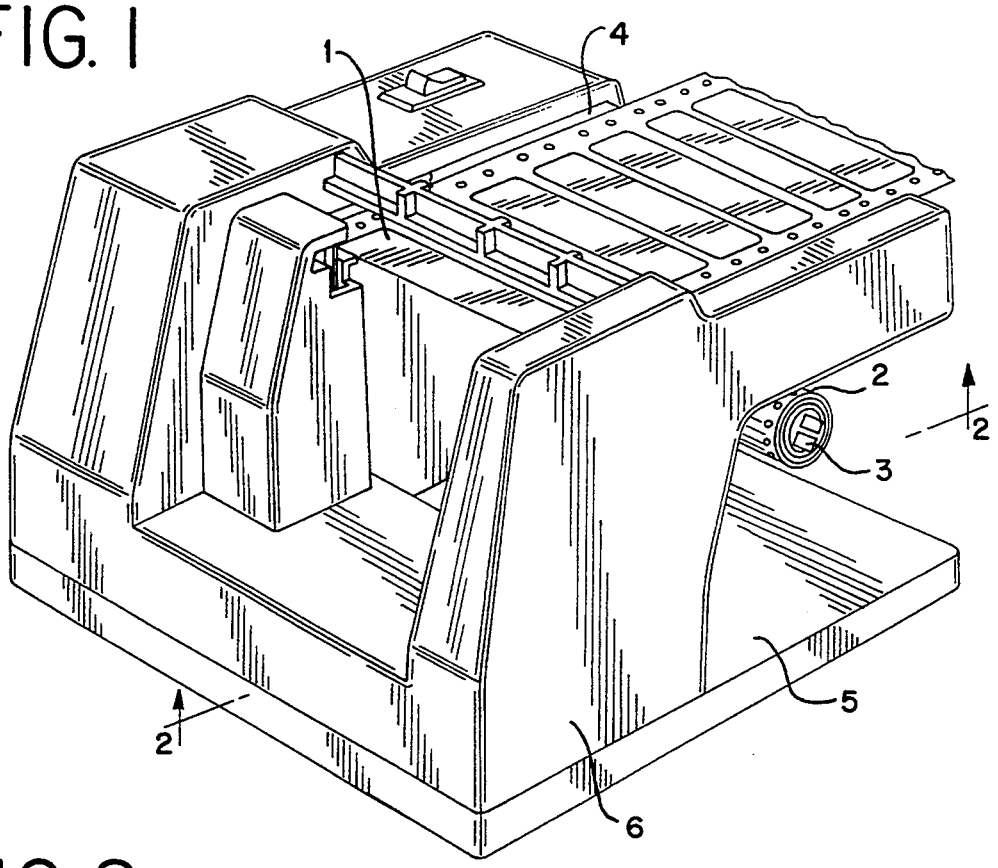
FIG. 1 is a perspective view of the label dispenser with the label carrier sheet in position for operation.

Referring to FIG. 1, a perspective view of the label dispenser with the label carrier sheet having labels 1 and backing paper 2 in the operating position on the tray 4. The excess backing paper 2 is rolled onto the take-up shaft 3. The label dispenser has a base 5, and a body 6 that are molded plastic members designed to be snapped together without the need for separate fasteners.

Figure 2:
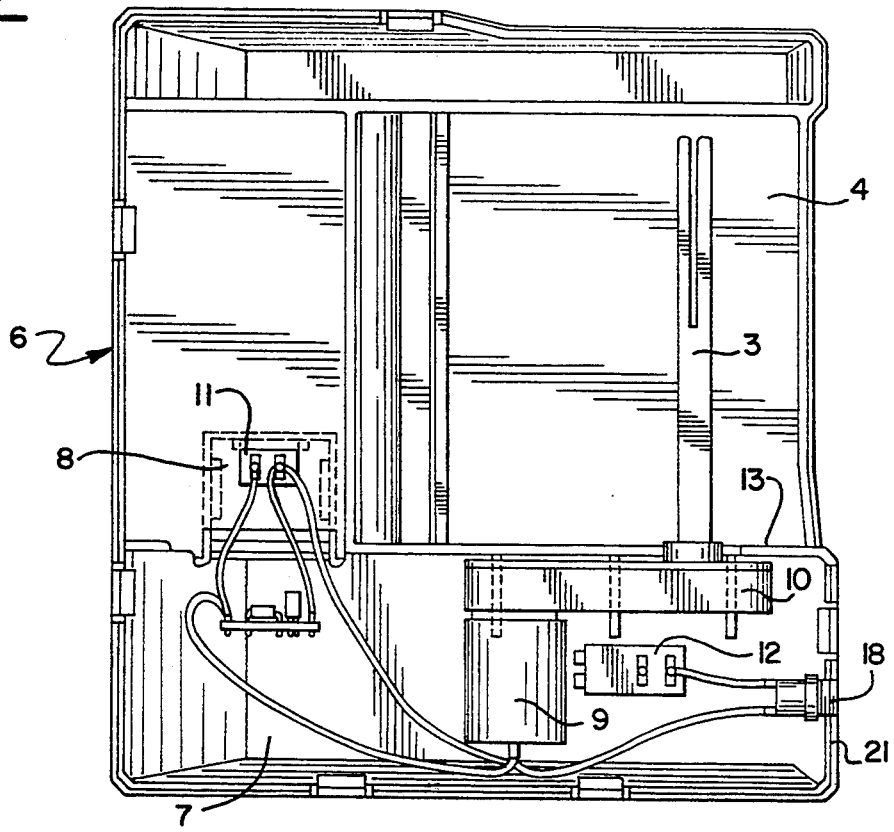
FIG. 2 is a bottom view of the body of the label dispenser showing the gear motor with take-up shaft, manual switch, and microswitch in their respective positions.

Referring to FIG. 2, a bottom view of the body 6 is shown. The body 6 has a motor housing portion 7 and a microswitch housing portion 8. The gear motor comprises an electric motor 9 connected to the plastic gear assembly 10 which are housed in the motor housing portion 7 of the body 6. The take-up shaft 3 is connected to the gear assembly 10 and extends through an opening formed in the inner side wall 13 of the motor housing portion 7 and into an open area beneath the tray portion 4. The microswitch 11 is attached to a side wall of the microswitch housing portion 8 and is electrically connected to the electric motor 9 and manual switch 12. The motor 9 and switches are electrically connected to a receptacle 18 which extends into an opening formed between a side wall 21 of the motor housing portion and the base. The receptacle 18 is designed to receive an electric cord and plug which can be inserted in an electrical outlet.

Figure 3:
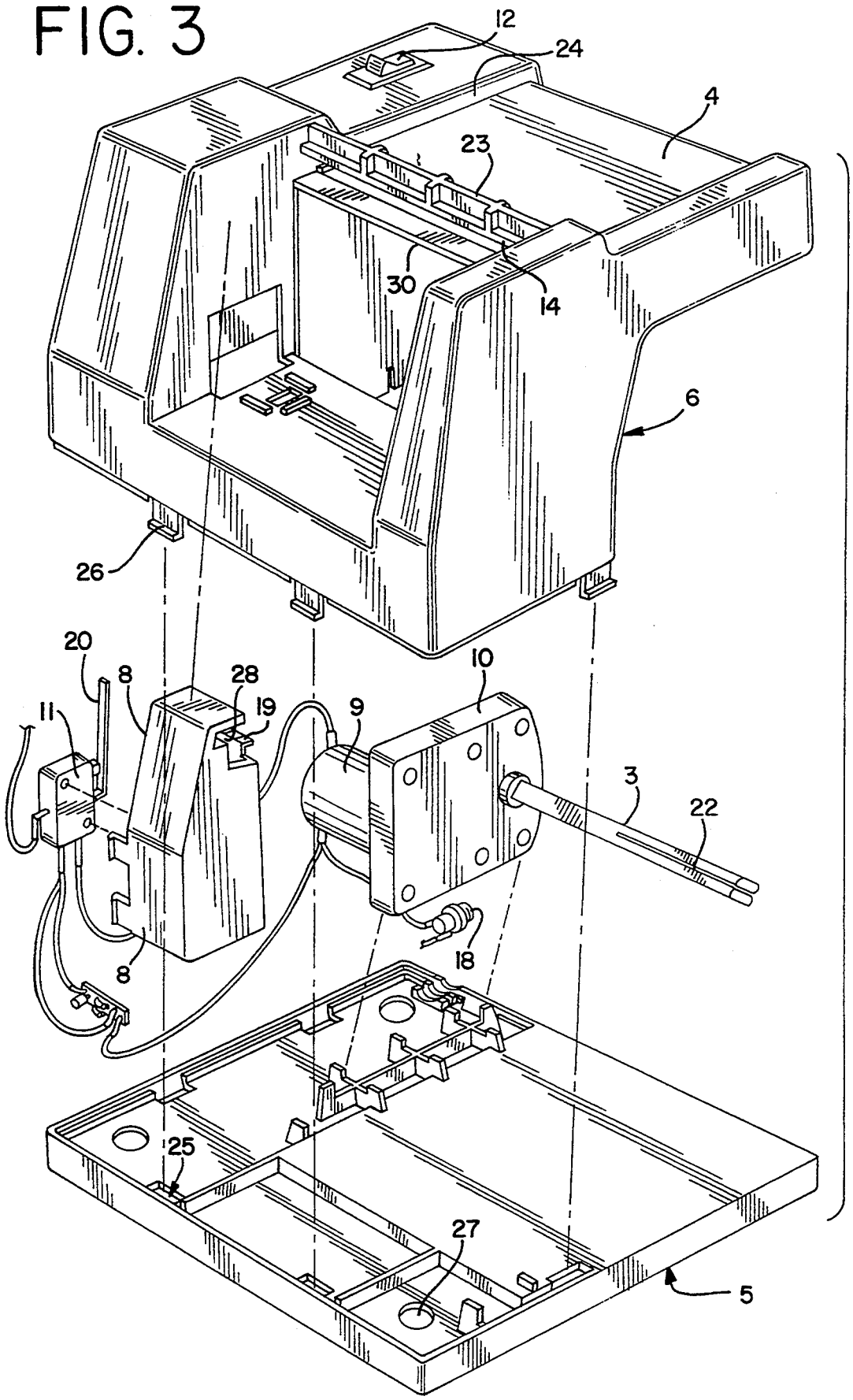
FIG. 3 is and exploded perspective view of the label dispenser.

Referring to FIG. 3, an exploded perspective view of the label dispenser is shown with the base 5, the body 6 and the microswitch housing portion 8 separated. The plastic microswitch housing portion 8 is designed to snap onto the body 6 without the need of separate fasteners. A microswitch lever arm 20 extends upwards into a label pocket 28 formed in the microswitch housing portion 8. The base 5 has openings 25 formed along its edges to receive tabs 26 which are formed along the bottom edge of the body 6. The base also has openings 27 to receive rubber feet to prevent scratching of a table top. The tray portion 4 has raised sides 24 to guide the carrier sheet during operation. A feed slot 14 is provided between the upper surface of the tray 4 and a hold down bar 23 which is formed above the tray surface. The hold down bar 23 prevents the carrier sheet from bending during operation.

Referring to FIG. 4, a sectional view of the microswitch housing portion 8 is shown. The lip portion 19 has a stepped or ridged surface to reduce the contact area with the adhesive side of a label. This stepped surface prevents jamming and allows for easy removal of the label. The lever arm 20 of the microswitch 11 extends upward into the pocket 28. The pre-operating position of the lever arm 20 is adjacent the lip portion 19. During operation the lever arm 20 is moved back away from the lip portion 19 by the incoming label.

Referring to FIG. 5, a schematic view of the plastic gear assembly 10 is shown. The motor gear 15 drives the gear assembly. The end gear 16 has an opening 17 formed at its center for receiving the take-up shaft 3.

To operate the label dispenser the lead-in backing paper portion of a label carrier sheet is fed through the feed slot 14 beneath the hold down bar 23 and then downward between the tray edge 30 and the lip portion 19 of the label pocket. The backing paper is folded and inserted in the slot 22 formed in the take-up shaft 3. To activate the motor 9 the manual switch 12 is pressed on. As the take-up shaft 3 turns it rolls up the excess backing paper 2. The first label 1 is peeled away from the backing paper 2 as the backing paper is pulled over the tray edge 30. The label slides over the stepped surface of the lip 19 and the edge of the label 1 contacts the lever arm 20 of the microswitch 11, pushing it back. This action deactivates the motor 9. The user may then remove the label 1 from the pocket 28 and lip 19. The small surface area of the stepped lip portion in contact with the adhesive backed label provides for easy removal. As the label is removed, the lever is released which reactivates the motor. The carrier sheet is again advanced and the backing paper is rolled onto the take-up shaft exposing the next label.

While the invention has been described in reference to a certain embodiment, those skilled in the art will recognize modification of structure, arrangement, composition and the like that can be made to the present invention that will fall within the scope of the invention claimed.

I claim:

1. A label dispenser comprising:

a base;

a body attached to a top surface of said base and having a motor housing portion, a microswitch housing portion, and an upper tray portion;

a gear motor enclosed in said motor housing portion, said gear motor having an opening for receiving a shaft, said shaft extending outside said motor housing portion and below said upper tray portion through an opening formed in a side wall of said motor housing portion;

a microswitch attached to an inner wall of said microswitch housing portion, said microswitch electrically connected to said motor and having a lever arm extending upward into an opening formed in said microswitch housing portion.

2. The label dispenser of claim 1 further comprising a stepped lip portion formed on an upper portion of said microswitch housing portion.

3. The label dispenser of claim 1 further comprising a ridged lip portion formed on an upper portion of said microswitch housing portion.

4. The label dispenser of claim 1 wherein the gear motor comprises an electric motor and a plastic gear assembly.

5. The label dispenser of claim 1 wherein the base and the body are molded plastic members that are snapped together.

6. The label dispenser of claim 1 wherein the base has openings formed therein along its edge for receiving tabs formed on the bottom edge of said body.

7. The label dispenser of claim 1 further comprising a feed slot formed between an upper surface of the tray and a hold down bar formed above said surface.

8. The label dispenser of claim 1 wherein the microswitch housing portion is a separate plastic member that snaps onto the body.

9. A method of operating a label dispenser comprising:

feeding a lead-in portion of a carrier sheet through a feed slot formed in a tray portion of a body of the label dispenser, said body is attached to a base, said body having a motor housing portion for holding a gear motor and a microswitch housing portion for holding a microswitch;

feeding the lead-in portion of the carrier sheet downward between the edge of the tray portion and a lip portion of said microswitch housing portion, said microswitch housing portion having a pocket formed therein for allowing a lever arm of the microswitch to extend into the pocket;

inserting the front edge of the lead-in portion into a slot formed in a take-up shaft, said shaft extends through an opening in a side wall of the motor housing portion and is attached to the gear motor;

switching on a manual switch to activate the gear motor which rotates the shaft, said manual switch electrically connected to the gear motor and to the microswitch, said manual switch being fitted in an opening formed in the body, said motor being connected to an electric cord and plug that is inserted in an electrical outlet, rolling the carrier sheet onto the rotating shaft until a first label contacts the lever arm in the label pocket which deactivates the motor;

removing the label from the label pocket which releases the lever arm and reactivates the motor which rotates the shaft and advances the carrier sheet to expose the next label.

10. The method of claim 9 wherein the body and base are molded plastic members that are snapped together.

11. The method of claim 9 wherein the microswitch housing portion is a separate plastic member that snaps onto the body.

12. The method of claim 9 wherein the gear motor comprises an electric motor attached to a plastic gear assembly.

13. The method of claim 9 wherein the feed slot comprises a space between an upper surface of the tray portion and a hold down bar formed above said upper surface.

14. A label dispenser comprising:

a base;

a body attached to a top surface of said base and having a motor housing portion, a microswitch housing portion, and an upper tray portion, said motor housing portion having an opening formed in an outside wall for allowing access to an electric cord and plug, said microswitch housing portion having a pocket formed therein, said upper tray portion having a feed slot formed therein for allowing a label carrier sheet to pass through;

a gear motor enclosed within said base and said motor housing portion, said gear motor having an opening for receiving a shaft, said shaft extending outside said motor housing portion and below said upper tray portion through an opening formed in a side wall of said motor housing portion, said shaft having a slot formed therein for receiving a label carrier sheet;

a manual switch attached to an opening formed in a wall of the body for turning on the gear motor;

a microswitch attached to an inner wall of said microswitch housing portion, said microswitch electrically connected to said motor and said manual switch and having a lever arm extending upward into the pocket, said microswitch housing portion having a lip portion adjacent said pocket.

15. The label dispenser of claim 14 wherein the base has openings formed therein along its edge for receiving tabs formed on the bottom edge of said body.

16. The label dispenser of claim 14 wherein the base and body are molded plastic members that are snapped together.

17. The label dispenser of claim 14 wherein the feed slot comprises a space between an upper surface of the tray portion and a hold down bar formed above said upper surface.

18. The label dispenser of claim 14 wherein the lip portion is ridged for reducing the contact area with the adhesive side of a label.

19. The label dispenser of claim 14 wherein the lip portion is stepped for reducing the contact area with the adhesive side of a label.

20. The label dispenser of claim 14 wherein the gear motor comprises an electric motor and a plastic gear assembly.

* * * * *